US005085124A

United States Patent [19]

Kimura

[11] Patent Number: 5,085,124

[45] Date of Patent: Feb. 4, 1992

[54] DIRECTIONAL CONTROL VALVE FOR PNEUMATIC CYLINDER

[75] Inventor: Takashi Kimura, Nagoya, Japan

[73] Assignee: Hirotaki Manufacturing Co., Ltd., Nagoya, Japan

[21] Appl. No.: 640,149

[22] Filed: Jan. 11, 1991

Related U.S. Application Data

[62] Division of Ser. No. 442,210, Nov. 28, 1989.

[30] Foreign Application Priority Data

Dec. 5, 1988 [JP] Japan ..... 63-307186

[51] Int. Cl.[5] ..... F15B 13/043

[52] U.S. Cl. ..... 91/433; 91/461; 137/596.16; 137/627.5

[58] Field of Search ..... 91/433, 461; 137/596.16, 627.5

[56] References Cited

U.S. PATENT DOCUMENTS

| | | | |
|---|---|---|---|
| 4,425,940 | 1/1984 | Cook | 137/627.5 |
| 4,531,548 | 7/1985 | Gottling et al. | 137/627.5 |
| 4,638,837 | 1/1987 | Buike et al. | 137/627.5 |
| 4,898,203 | 2/1990 | Kobelt | 137/627.5 |
| 4,919,168 | 4/1990 | Wagner | 137/627.5 |

*Primary Examiner*—Gerald A. Michalsky
*Attorney, Agent, or Firm*—Oliff & Berridge

[57] ABSTRACT

A directional control valve for a pneumatic cylinder in which a piston of the cylinder can be lowered and elevated in a high speed with a minimum air consumption and the lowering/rising speed of the piston can be controlled before it reaches the upper/lower end portions to prevent bounding of the piston. The directional control valve includes a first pressure chamber communicating with an air supply, a second pressure chamber communicating with one of cylinder chambers divided by the piston of the cylinder, an exhaust pressure port, a pressure controlling mechanism, a pressure controlling and changing means which forms a pressure controlling chamber and a pressure receiving chamber, a first valve member for communicating the first pressure chamber and the second pressure chamber, a second valve member for communicating the second pressure chamber and an atmospheric pressure chamber, a third valve member for communicating the second pressure chamber and a pressure-receiving member, and a fourth valve member which is communicating with the third valve member, the air supply and a pressure control chamber.

5 Claims, 6 Drawing Sheets

DIRECTIONAL CONTROL VALVE FOR PNEUMATIC CYLINDER

This is a division of application Ser. No. 07/442,210 filed Nov. 28, 1989.

BACKGROUND OF THE INVENTION

1. Field of the Invention

This invention relates to a directional control valve (reduction valve) for a pneumatic cylinder.

2. Prior Art

For conventional pneumatic cylinders, some shortcomings as described below have been indicated.

When a heavy article is moved downward by utilizing a pneumatic cylinder, the speed for lowering the article is usually controlled by throttling an air outlet of the pneumatic cylinder. At this time, the pressure of the exhausted air is increased, which results in high energy loss.

In the case where the speed of a piston of the pneumatic cylinder is decreased, the area of the air outlet is reduced. If the piston speed is suddenly controlled, bounding of the piston is caused due to the compressibility of air. To prevent such bounding of the piston, a shock absorber is additionally required when the piston is moved at a high speed. Even in this case, an energy loss is caused when the kinetic energy is changed into thermal energy.

Moreover, when the piston is moving at a constant speed, it is difficult to smoothly reduce the speed of the piston from an optional position only by utilizing an air circuit.

Furthermore, bounding of the piston is apt to occur at the moment when the piston starts lowering, and also delay is caused when the piston starts rising.

SUMMARY OF THE INVENTION

The principal object of the present invention is to provide a directional control valve for a pneumatic cylinder which can solve the above-mentioned problems of the conventional pneumatic cylinders. Referring to individual points:

One object of the present invention is to provide a directional control valve which can realize smooth and high-speed lowering of a piston of a pneumatic cylinder with a minimum energy loss.

Another object of the present invention is to remove a shock, i.e., bounding of the piston, which is apt to occur when the piston stops at the lower and the upper end positions.

A further object of the present invention is to provide a directional control valve for a pneumatic cylinder featuring a quick rising start as well as a higher rising speed for the piston of the cylinder.

To achieve these objects, the present invention has a constitution as set forth below. Namely, the directional control valve for a pneumatic cylinder of the present invention, having a piston and a rod being connected to the piston, includes: a first pressure chamber communicating with an air supply; a second pressure chamber communicating with one of two cylinder chambers separated by the piston of the cylinder; an atmospheric pressure chamber; a pressure controlling mechanism; and a pressure controlling and changing means which is driven by the pressure controlling mechanism and which forms a pressure-controlling chamber in the pressure controlling mechanism side and a pressure-receiving chamber in the opposite side; a first valve member for disconnectably communicating the first pressure chamber and the second pressure chamber; a second valve member for disconnectably communicating the second pressure chamber and the atmospheric pressure chamber: a third valve member for disconnectably communicating the second pressure chamber and the pressure-receiving chamber; and a fourth valve member being in communication with the third valve member, the air supply, and the pressure-controlling chamber.

Operation of the present directional control valve for a pneumatic cylinder will be described in detail hereinafter.

(1) When decreasing a lowering speed of a heavy article, the second pressure chamber of the directional control valve communicates with the pressure-receiving chamber via the third valve member. As a result, the second pressure chamber and an atmospheric pressure chamber communicate with each other through a small opening, and the air in the pneumatic cylinder slowly flows into the atmospheric pressure chamber via the second pressure chamber. Thus, the article is slowly lowered.

(2) In order to rapidly lower the piston of the pneumatic cylinder, air is supplied to the pressure-receiving chamber of the directional control valve via the third valve member. As a result, the pressure control piston of the directional control valve moves upward and elevates the first and second valve members of the directional control valve. The elevation of the first valve member prevents communication between the first pressure chamber and the second pressure chamber of the directional control valve, while elevation of the second valve member allows communication between the second pressure chamber and the atmospheric pressure chamber. Thereby, the air in the cylinder is exhausted at a fast speed to rapidly lower the piston of the pneumatic cylinder.

(3) The piston of the pneumatic cylinder is rapidly elevated by exhausting the air in the pressure-receiving chamber of the directional control valve via the third and the fourth valve members. Due to the exhaust mentioned above, the pressure control piston moves downward to push the first valve member of the directional control valve downward. As a result, the first pressure chamber and the second pressure chamber of the directional control valve communicate with each other, and then the air from the air supply flows into the cylinder chamber of the pneumatic cylinder to elevate the piston at a fast speed.

(4) The pneumatic cylinder is slowly elevated as follows.

The pressure control piston of the directional control valve is lowered by air pressure. Then, the pressure-receiving chamber and the second pressure chamber of the directional control valve are allowed to communicate with each other via the third valve member. Furthermore, the second pressure chamber communicates with the first pressure chamber via the small opening. Thus, the air is slowly provided to the cylinder chamber from the air supply via the first and the second pressure chambers of the directional control valve. Accordingly, the piston of the pneumatic cylinder is slowly elevated.

BRIEF DESCRIPTION OF THE DRAWINGS

By way of example, and to make the description clearer, reference is made to accompanying drawings in which.

DETAILED DESCRIPTION OF PREFERRED EMBODIMENTS

Set forth is the explanation of preferred embodiments of the present invention with reference to the attached drawings.

Figure 1:
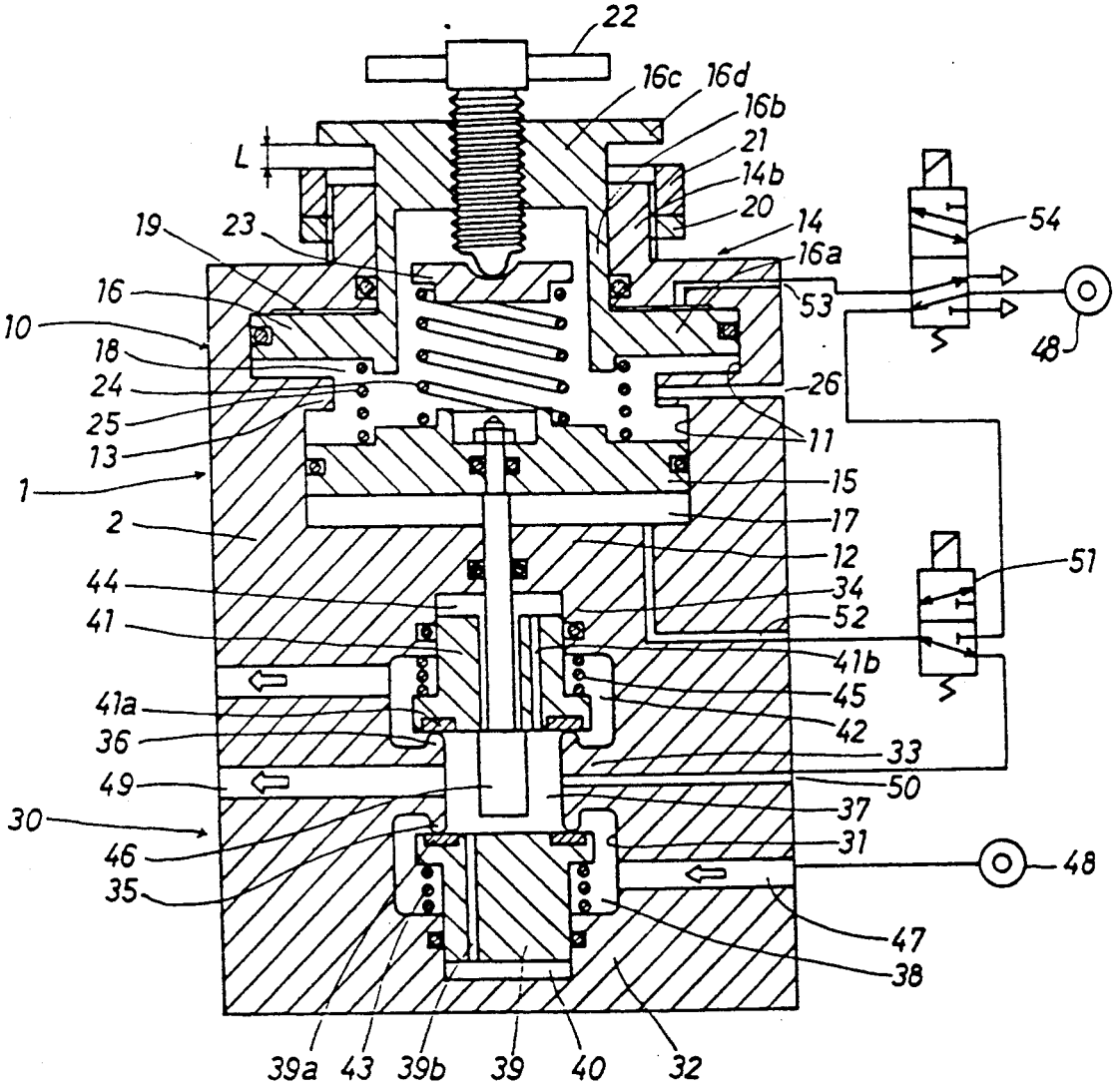
FIG. 1 is a longitudinal sectional view of a first embodiment of the present invention.

A first embodiment is described based on FIG. 1. A directional control valve 1 has a cylindrical housing 2 which is composed of a controller body 10 (upper part) and a decompression valve body 30 (lower part). In the controller body 10, a bottom wall 12, a ,middle flange 13, and a top flange 14 are configured to define a first internal hole 11 of the housing 2. A first pressure-controlling piston 15 is installed between the bottom wall 12 and the middle flange 13 to be slidable in an air-tight condition in the internal hole 11. Moreover, a second pressure-controlling piston 16 is stored between the middle flange 13 and the top flange 14 to be slidable in an air-tight condition. The space provided between the bottom wall 12 and the first pressure-controlling piston 15 functions as a pressure-receiving chamber 17. Moreover, the space formed between the first pressure-controlling piston 15 and the second pressure-controlling piston 16 functions as a back pressure chamber 18, and that between the second pressure-controlling piston 16 and the top flange 14 functions as a controlling chamber 19.

The second pressure-controlling piston 16 consists of a flange 16*a* which is extending outwardly, a first cylindrical portion 16*b* and a top wall 16*c*. The flange 16*a* slides along the first internal hole 11, and the first cylindrical portion 16*b* slides along the internal surface of a second cylindrical portion 14*b* of the top flange 14. The upper end portion of the top wall 16*c* is extending outwardly, which forms a contacting portion 16*d*. The external surface of the second cylindrical portion 14*b* is threaded, and a locknut 20 is fitted to this portion. Moreover, a circular stopper 21 is screwed onto the second cylindrical portion 14*b*. A space L, whose capacity is adjustable, is provided between the stopper 21 and the contacting portion 16*d* of the second pressure-controlling piston 16. In the center part of the top wall 16*c*, a screw handle 22 is installed. The lower end of the screw handle 22 functions to push the first pressure-controlling piston 15 downward via a spring bearing 23 and a first control spring 24. Moreover, a second control spring 25 is installed between the first and the second pressure-controlling pistons 15 and 16. The middle flange 13 is provided with a bleed hole 26.

In the decompression valve body 30, a bottom flange 32, a middle flange 33, and an upper flange 34 are defined the second internal hole 31 which is concentric with a first internal hole 11 of the housing 2. The upper flange 34 and the bottom wall 12 are connected in one united body. At the upper and the lower portions of the internal ends of the middle flange 33, a second valve seat 36 and a first valve seat 35, respectively, are formed in a circular shape. Moreover, the internal ends of the middle flange 33 forms a cylindrical second pressure chamber 37.

The space between the bottom flange 32 and the second middle flange 33 functions as a first pressure chamber 38. In this pressure chamber 38, a first valve member 39 is installed. The lower part of the first valve member 39 is air-tightly and slidably installed in a first valve chamber 40 which is formed by the bottom flange 32. A first valve head 39*a* of the first valve member 39 is able to contact with the first valve seat 35 of the middle flange 33. The first valve member 39 is provided with a first valve hole 39*b* for communicating between the second pressure chamber 37 and the first valve chamber 40. The first valve member 39 is pushed upward by a first valve spring 43.

On the other hand, an atmospheric (exhaust gas) pressure chamber 42, which is connected to the outside air, is formed between the middle flange 33 and the upper flange 34. A second valve member 41 is installed in the atmospheric pressure chamber 42. The upper part of the second valve member 41 is air-tightly and slidably installed in a second valve chamber 44 which is formed by the upper flange 34. A second valve head 41*a* of the second valve member 41 is able to contact with the second valve seat 36 of the middle flange 33. The second valve member 41 is provided with a second valve hole 41*b* for allowing communication between the second pressure chamber 37 and the second valve chamber 44. The second valve member 41 is pushed downward by a second valve spring 45.

At the center of the first pressure-controlling piston 15, the upper end portion of a stem 46 is secured. The middle part of the stem 46 is air-tightly penetrating through the bottom wall 12 and loosely passes through the second valve member 41. The diameter of the lower part of the stem 46 is made larger than that of the middle part so as to prevent the second valve member 41 from falling off. Moreover, the lower end of the stem 46 is able to contact with the upper surface of the first valve member 39 when the first pressure-controlling piston 15 is moved downward.

The first pressure chamber 38 communicates, via a first pressure chamber port 47, with an air supply 48. The second pressure chamber 37 communicates, via a second pressure chamber path 49, with a cylinder chamber of a pneumatic cylinder (not shown). Moreover, the second pressure chamber 37 is able to communicate with the pressure-receiving chamber 17 via a second pressure chamber port 50, a three-port two-position pneumatic solenoid valve (hereinafter referred to as a three-port solenoid valve) 51, and a pressure-receiving chamber port 52.

On the other hand, a pressure-controlling chamber 19 is able to communicate with a five-port two-position pneumatic solenoid valve (hereinafter referred to as a five-port solenoid valve) 54 via a controlling chamber port 53. The five-port solenoid valve 54 is connected to the three-port solenoid valve 51, and communicates with the air supply 48.

Based on the above-mentioned condition, when the pneumatic cylinder is under the condition shown in the figure, the first valve member 39 does not contact with the lower end of the stem 46. The first valve member 39 is provided with a spring force from the first valve spring 43 and the first valve head 39*a* contacts the valve seat 35. On the other hand, a spring force from the second valve spring 45 is applied to the second valve member 41, and the second valve head 41*a* contacts the second valve seat 36. The first pressure-controlling piston 15 is apart from the bottom wall 12, which forms a pressure-receiving chamber 17. The second pressure-controlling piston 16 contacts the top flange 14. Since the controlling chamber 19 is opened to the outside air, the capacity of the chamber is small. The pressure-receiving chamber 17 and the second pressure chamber 37 communicate with each other via the second pressure chamber port 50, the three-port solenoid valve 51, and the pressure-receiving chamber 52.

Under the above-mentioned conditions, when the handle 22 is screwed to push the first pressure-controlling piston 15 and the stem 46 downward via the spring bearing 23 and the first control spring 24, the stem 46 contacts the first valve member 39 and pushes it downward, while the second valve member 41 is kept in contact with the second valve seat 36. As a result, the first pressure chamber 38 communicates with the second pressure chamber 37, and the first air is supplied from the air supply 48 to the second pressure chamber 37. A part of the air supplied to the second pressure chamber 37 is sent to the pressure-receiving chamber 17 by way of the second pressure chamber port 50, the three-port solenoid valve 51, and the pressure-receiving chamber port 52, thereby the first pressure-controlling piston 15 is pushed up. In accordance with this movement, the stem 46 is elevated, and also the first valve member 39 is pushed up by the first valve spring 43 to contact the stem 46. As a result, the pressure in the second pressure chamber 37 and the spring force of the first control spring 24 are balanced. On the other hand, the pressure in the second pressure chamber 37 can be controlled also by supplying compressed air from the air supply 48 to the controlling chamber 19 via the five-port solenoid valve 54, thereby pushing the second pressure-controlling piston 16 downward. The traveling amount of the second pressure-controlling piston 16 is regulated by a clearance L between the stopper 21 and the contacting portion 16*d* of the second pressure-controlling piston 16. The clearance L is controllable by the rotation of a locknut 20.

Figure 2:
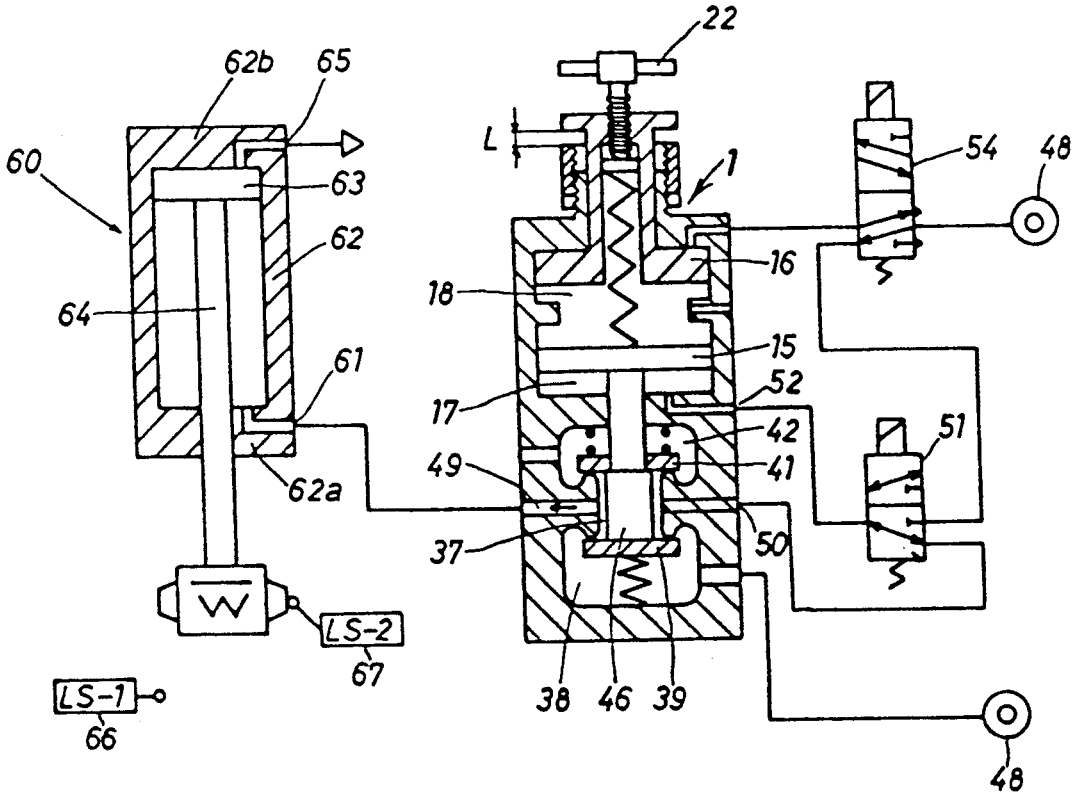
FIG. 2 is a longitudinal sectional view of a first using example.

The operation of the directional control valve 1 having the above-mentioned constitution is explained based on the combination of the directional control valve 1 and a pneumatic cylinder 60, with reference to FIG. 2, FIG. 3, and Table 1.

FIG. 2 shows the directional control valve 1 being connected to the pneumatic cylinder 60. Under this condition, the second pressure chamber port 49 of the directional control valve 1 is communicating with a rod-side port 61 of the pneumatic cylinder 60. In the cylinder 60, a piston 63 is air-tightly and slidably installed in a cylinder body 62, and a rod 64 which is connected to the piston 63 is also air-tightly and slidably penetrating through a lower end wall 62*a* of the cylinder body 62. The lower end portion of the rod 64 is equipped with a weight W. Moreover, an upper end wall 62*b* of the cylinder body 62 is provided with a head-side port 65. Limit switches 66 and 67 respectively detect positions at which rising speed and lowering speed of the piston 63 begin to decelerate. The three-port solenoid valve 51 (Sol 1 in Table 1) and the five-port solenoid valve 54 (Sol 2 in Table 1) are arranged as shown in FIG. 2.

FIGS. 3A through 3D show typical operations of the directional control valve 1.

Figure 3A:
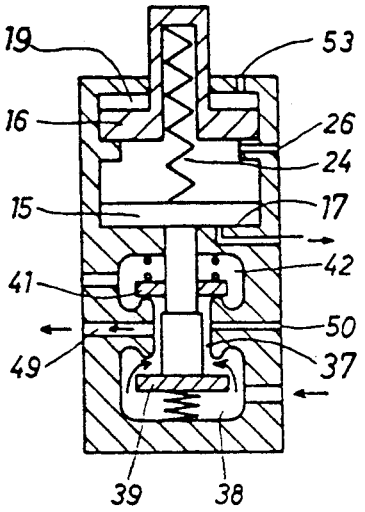
FIGS. 3A, 3B, 3C and 3D are model views illustrating operational states of the first using example.

FIG. 3A illustrates the condition when the piston 63 is rapidly elevated. When power is supplied to the three-port solenoid valve 51 and the five-port solenoid valve 54, compressed air is provided from the air supply 48 to the controlling chamber 19 via the five-port solenoid valve 54, thereby the second pressure-controlling piston 16 is pushed down. In response to this movement, the first pressure-controlling piston 15 is pushed downward, and the air in the pressure-receiving chamber 17 is exhausted into the outside via the three-port solenoid valve 51 and the five-port solenoid valve 54. On the other hand, the first valve member 39 is pushed downward by the stem 46. As a result, the first pressure chamber 38 and the second pressure chamber 37 can communicate with each other, and the air is supplied from the air supply 48 to the rod-side of the pneumatic cylinder 60. Thus, the piston 63 with the weight W is rapidly elevated. At this time, the pressure in the second pressure chamber 37 is equal to that of the first pressure chamber 38.

Figure 3C:
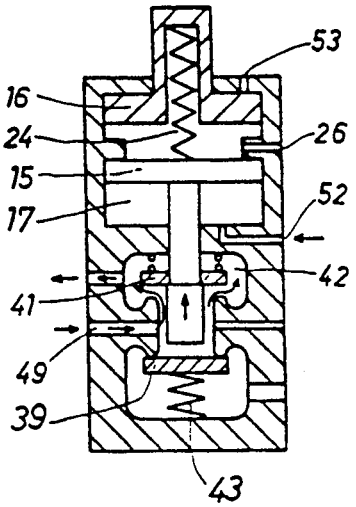
Figure 3B:
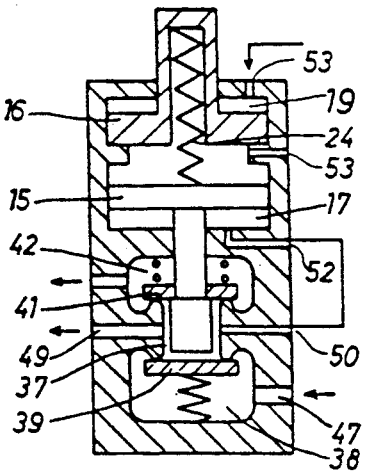

FIG. 3B shows the condition that the piston 63 is elevated slowly and is stopped at the upper end portion of the pneumatic cylinder 60.

When the three-port solenoid valve 51 is not powered and the five-port solenoid valve 54 is powered, the compressed air is supplied from the air supply 48 to the controlling chamber 19 via the five-port solenoid valve 54, thereby the second pressure-controlling piston 16 is pushed downward. In accordance with this movement, the first pressure-controlling piston 15 is lowered, and the pressure-receiving chamber 17 communicates with the second pressure chamber 37 via the three-port solenoid valve 51. Under such conditions, the pressure in the second pressure chamber 37 is controlled to be high by the first control spring 24, and the second pressure chamber 37 communicates with the first pressure chamber 38 via a small opening between first valve seat 35 and first valve head 39*a*. Then, the compressed air in the air supply 48 gradually flows from the first pressure chamber 38 to the second pressure chamber 37, and further to the rod-side port 61 of the pneumatic cylinder 60. As a result, the piston 63 is slowly elevated until finally the piston 63 reaches the upper end position.

FIG. 3C indicates the condition that the piston is rapidly lowered.

By supplying power to the three-port solenoid valve 51 and no power to the five-port solenoid valve 54, the compressed air of the air supply 48 is sent, through the five-port solenoid valve 54 and the three-port solenoid valve 51, to the pressure-receiving chamber 17. As a result, the first pressure-controlling piston 15 is elevated. In accordance with this movement, the second valve member 41 is raised by means of the stem 46, and the second pressure chamber 37 communicates with the atmospheric pressure chamber 42. At the same time, the first valve member 39 is pushed up by the first spring 43, which results in preventing communication between the second pressure chamber 37 and the first pressure chamber 38. As a result, the air in the cylinder chamber in the rod side of the pneumatic cylinder 60 is suddenly exhausted into the outside, and the piston is lowered rapidly.

Figure 3D:
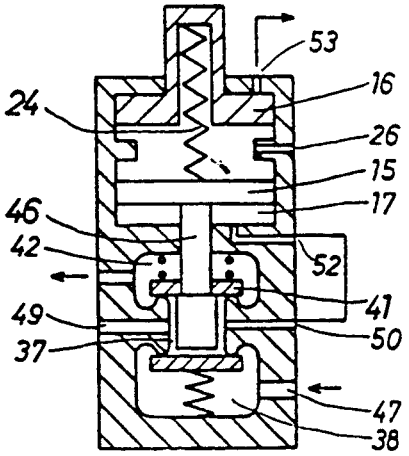

FIG. 3D shows the condition in which the piston 63 is slowly lowered until it reaches the lower end portion. When both the three-port solenoid valve 51 and the five-port solenoid valve 54 are not excited, the compressed air in the air supply 48 is not provided to the directional control valve 1. The second pressure chamber 37 communicates with the pressure-receiving chamber 17 via the second pressure chamber port 50, the three-port solenoid valve 51, and the pressure-receiving chamber port 52. As a result, the first pressure-controlling piston 15 is elevated by the air exhausted from the pneumatic cylinder 60, and also the second valve member 41 is raised by means of the stem 46. Since the pressure in the second pressure chamber 37 is controlled to be high by the first control spring 24, the rising amount of the second valve 41 is small. The second pressure chamber 37 and the atmospheric pressure chamber 42 communicate with each other through a small opening between the second valve seat 36 and second valve head 41*a*. Since the air in the pneumatic cylinder 60 flows slowly from the second pressure chamber 37 to the atmospheric pressure chamber 42, the piston 63 is also lowered slowly, and finally reaches the lower end position.

As a modification, the first pressure-controlling piston 15 of the present embodiment may be replaced with other pressure controlling method such as diaphragm.

and the pressure controlling force of the pressure-controlling piston 115 are kept constant.

(A) low controlled pressure of the directional control valve 1 < controlled pressure of the directional control valve 101

(B) high controlled pressure of the directional control valve 1 > controlled pressure of the directional control valve 101

On the basis of the above-mentioned relations, fast and slow operations of the pneumatic cylinder 60 in the left-right direction can be realized.

Figure 5:
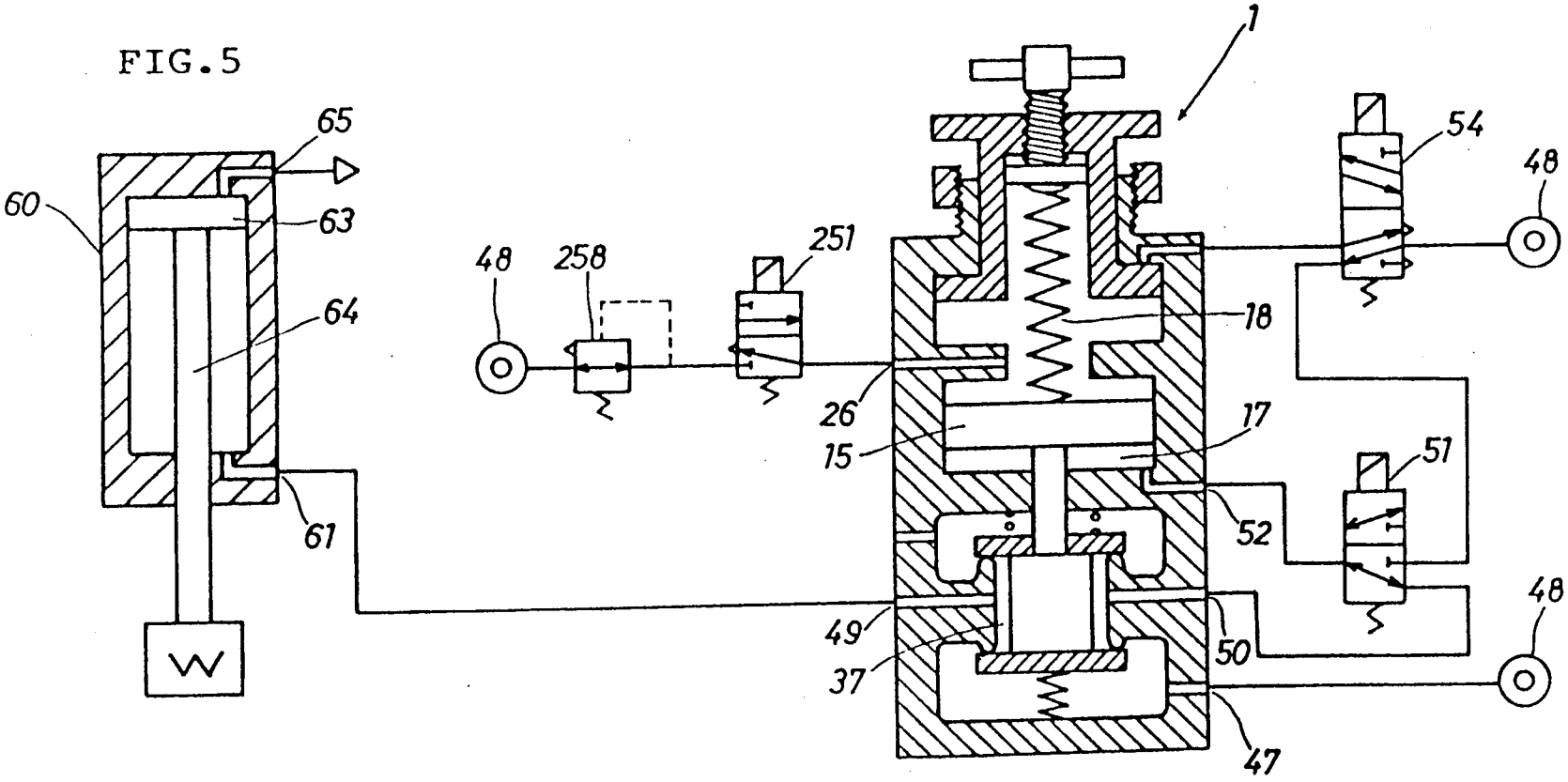
FIG. 5 is a longitudinal sectional view of a third using example.

FIG. 5 shows a third using example of the first embodiment. In the same manner as the first using example, the pneumatic cylinder 60 is vertically arranged. However, the bleed hole 26 of the directional control valve 1 is in communication with the air supply 48 via a three-port solenoid valve 251 and a decompression valve 258.

In such constitution, when the pneumatic cylinder 60 is applied with no load, a three-port solenoid valve 251 is not excited, and the pressure in the second pressure chamber 37 is controlled by the spring force of the control spring 24. On the other hand, when the pneumatic cylinder 60 is loaded, the three-port solenoid valve 251 is applied with electricity, and the decompressed air is provided from the air supply 48 to the back pressure chamber 18. The decompressed air pressure is added to the spring force of the control spring 24, which increases the pressure of the pressure-receiving chamber 17, i.e., the pressure of the second pressure chamber 37 and that of the rod-side cylinder chamber of the pneumatic cylinder 60. As a result, the movement of the piston of the pneumatic cylinder 60 is activated.

TABLE 1

| CONDITION OF PNEUMATIC CYLINDER | PRESSURE IN SECOND PRESSURE CHAMBER | PRESSURE IN PRESSURE-RECEIVING CHAMBER | SOL 1* | SOL 2* | SECOND PRESSURE SPRING FORCE | LIMIT SWITCH | PRINCIPLE DRAWING |
|---|---|---|---|---|---|---|---|
| RISING END POSITION | HIGH-PRESSURE CONTROL | SECOND PRESSURE | OFF | ON | LARGE | | B |
| RAPID LOWERING | EXHAUST | AIR SUPPLY | ON | OFF | SMALL | | C |
| SLOW LOWERING = LOWERING END POSITION | LOW-PRESSURE CONTROL | SECOND PRESSURE | OFF | OFF | SMALL | LS-1 | D |
| RAPID LOWERING | AIR SUPPLY = FIRST PRESSURE | EXHAUST | ON | ON | LARGE | | A |
| SLOW RISING | HIGH-PRESSURE CONTROL | SECOND PRESSURE | OFF | OFF | LARGE | LS-2 | D |

*ON = EXCITATION
OFF = NON-EXCITATION

Figure 4:
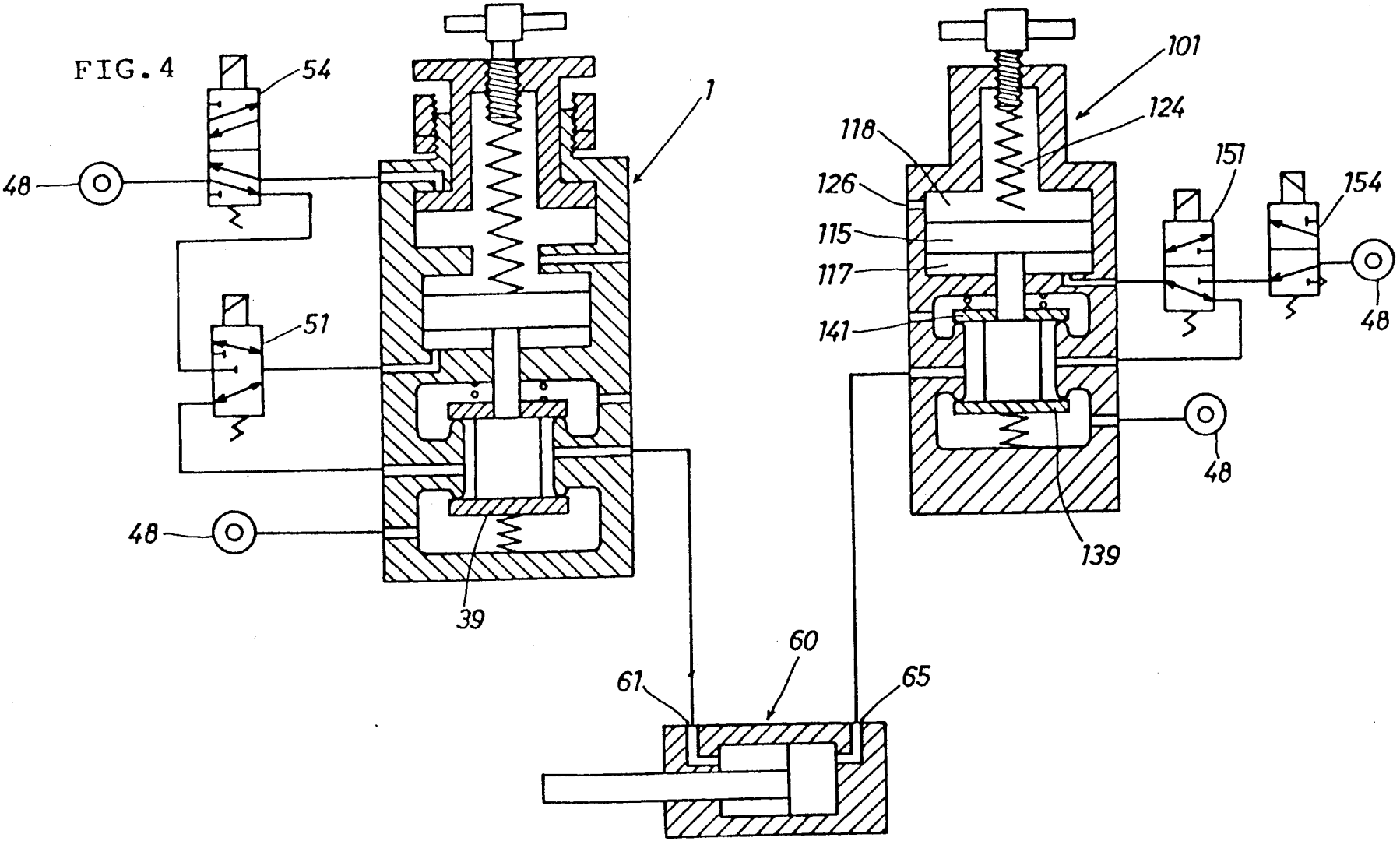
FIG. 4 is a longitudinal sectional view of a second using example.

FIG. 4 shows a second using example. It is different from the first using example shown in FIG. 2 in that the pneumatic cylinder 60 of the second using example is horizontally arranged and the head-side port 65 is connected to a second directional control valve 101. The second directional control valve 101 has the same construction as the directional control valve 1 except the second pressure-controlling piston 16 is removed. Each component corresponding to those of the first directional control valve 1 are denoted by numbers by adding 100 to the numbers used in the first using example, and the explanations for those components are referred to the first using example. For example, the number given to the pressure-controlling piston of the second directional control valve 101, corresponding to the first pressure-controlling piston 15 of the directional control valve 1, is 115.

The relation between the directional control valve 1 and the second directional control valve 101 is defined as follows, under the condition that the spring force of a spring 124 of the second directional control valve 101

Figure 6:
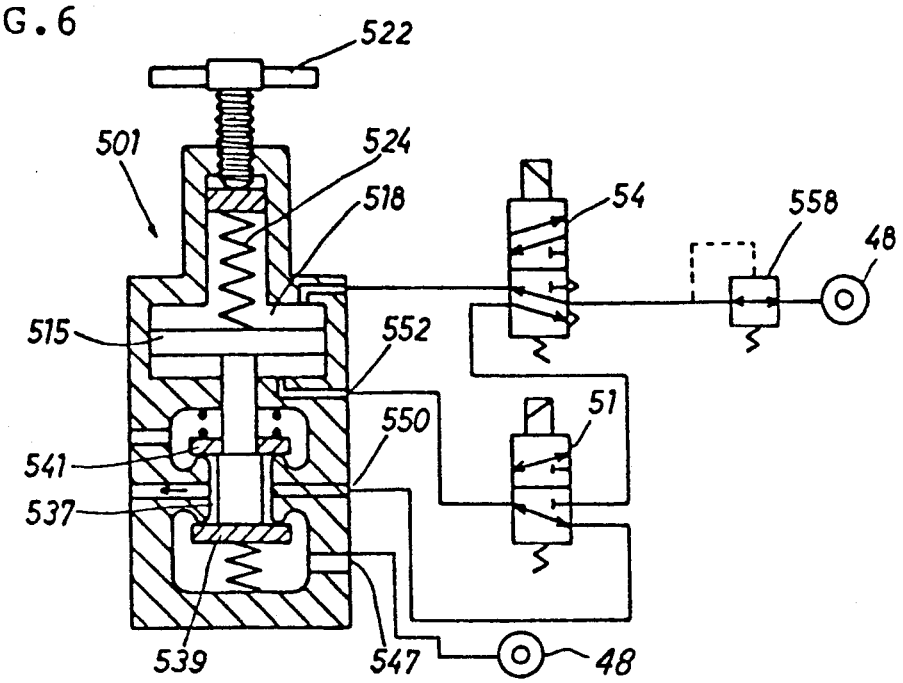
FIG. 6 is a longitudinal sectional view of a second embodiment of the present invention.

FIG. 6 shows a second embodiment of the present invention. A directional control valve 501 of this embodiment is same as the directional control valve 101 shown in FIG. 4, except for the location of two solenoid valves. Each of the components of the directional control valve 501 that are common to those of the valve 101 are numbered by adding 400 to the numbers used in the second using example of the first embodiment. For their operation, the explanations given in the first embodiment are applicable.

In the directional control valve 501, the five-port solenoid valve 54 is connected to a back pressure chamber 518, and also to the air supply 48 via a decompression valve 558. Accordingly, the pressure in a second pressure chamber 537 is controlled by the total of the air pressure and the spring force of a control spring 524. Otherwise, the operation of the directional control valve 510 is the same as that of the directional control valve 1. As a modification, a pressure-controlling piston 515 may be replaced with other pressure changing means such as diaphragm or the like.

Figure 7:
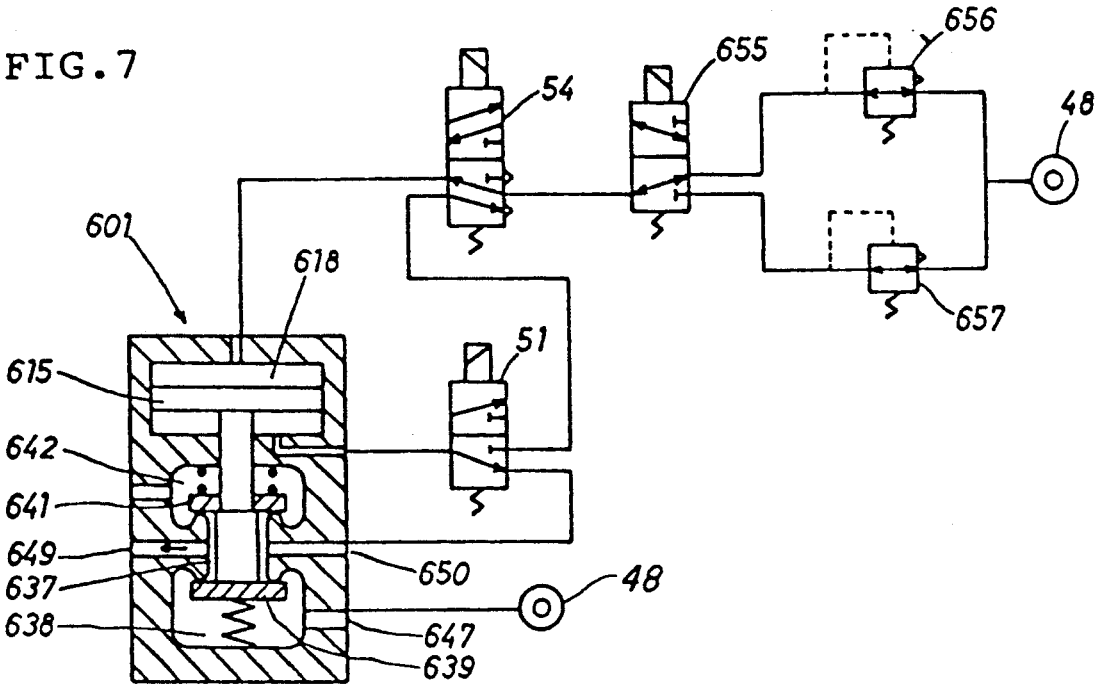
FIG. 7 is a longitudinal sectional view of a third embodiment of the present invention.

FIG. 7 shows a third embodiment of the present invention. In this embodiment, each of the components of directional control valve 601 that are common to those of the above-mentioned second embodiment are numbered by adding 100 to the numbers for those components of the directional control valve 501. The handle 522 and the spring 524, which are used as pressure-controlling means in the directional control valve 501 of FIG. 6, are not employed in this embodiment. Moreover, another three-port solenoid valve 655 is connected to the five-port solenoid valve 54 which is communicating with a back pressure chamber 618. The directional control valve 601 can communicate with the air supply 48 via a decompression valve for high pressure 656 when the solenoid valve 655 is not activated, and via a decompression valve for low pressure 657 when the solenoid valve 655 is activated. Namely, the directional control valve 601 of the third embodiment represents the method for controlling the pressure of a pressure-controlling piston 615 by utilizing the air pressure of the air supply 48. Otherwise, the operation of the valve 601 is the same as that of the valve 1. The pressure-controlling piston 615 may be replaced with other pressure controlling method such as a diaphragm or the like.

With the constitution described above, the directional control valve of the present invention can provide the following excellent effects.

(1) The rod never bounces in the pneumatic cylinder when the piston of the cylinder starts lowering from its top end position, because air is not supplied to the head side of the cylinder as in a conventional directional control valve and also the air in the rod side is exhausted.

(2) The lowering speed of the piston is fast, because the pressure applied to the rod side is small.

(3) Bounding of the piston, which is apt to occur when the piston stops at the lower end position, can be prevented. In order to prevent the shock, in the conventional pneumatic cylinder, the exhaust port is throttled when the piston comes close to the lower end position. If the lowering speed of the piston is fast and the load is large, the piston is likely to bound due to compressibility of the air. In the pneumatic cylinder of the present invention, however, the lowering speed is decreased before the piston stops at the lower end to prevent bounding of the piston.

(4) The pneumatic cylinder creates less delay in starting the piston rising than the conventional pneumatic cylinder, for in the conventional pneumatic cylinder, the air in the head side is exhausted in elevating the piston from its lower end position.

(5) The traveling speed of the piston during rising is faster than that in the conventional one.

(6) Bounding of the piston, which is likely to occur when it stops at the upper end position, can also be prevented owing to the same reason mentioned in (3).

(7) The consumption of air can be decreased in comparison with the conventional pneumatic cylinder.

While the invention has been particularly shown and described with reference to preferred embodiments, it will be understood by those skilled in the art that various other changes in form and detail may be made without departing from the spirit and scope of the invention.

What is claimed is:

1. A directional control valve for a pneumatic cylinder having a cylinder housing, a piston dividing the cylinder housing into two chambers, and a rod connected to the piston, the directional control valve comprising:

a control valve housing having an ambient pressure chamber communicating with an atmosphere surrounding both the pneumatic cylinder and the directional control valve;

a first pressure chamber communicating with an air supply;

a second pressure chamber communicating with one of the chambers of the cylinder housing;

a first valve means for selectively allowing communication between the first pressure chamber and the second pressure chamber; and a second valve means for selectively allowing communication between the second pressure chamber and the ambient pressure chamber; and further comprising:

a control means for controlling closing, partially opening, and fully opening one of the first valve means and the second valve means, wherein the control valve housing further defines a control means cavity and the control means comprises:

a pressure controlling piston movably mounted in the control means cavity, where a pressure receiving chamber is formed between the control valve housing and a first side of the pressure controlling piston;

a back pressure chamber formed between the control valve housing and a second side of the pressure controlling piston;

a linkage means secured to the pressure controlling piston for opening one of the first valve means and the second valve means corresponding to a movement of the pressure controlling piston; and the directional control valve further comprises an air supply/removal means for selectively supplying air to and removing air from the back pressure chamber and the pressure receiving chamber, the air supply/removal means comprising:

a third valve means for allowing the pressure receiving chamber to selectively communicate with the second pressure chamber, the air supply, and the atmosphere; and a fourth valve means for allowing the back pressure chamber to selectively communicate with the air supply and the atmosphere, in which the fourth valve means further communicates with the third valve means.

2. The directional control valve of claim 1, further comprising a fifth valve means between the fourth valve means and the air supply to selectively communicate with a low pressure air supply and a high pressure air supply.

3. A directional control valve for a pneumatic cylinder having a cylinder housing, a piston dividing the cylinder housing into two chambers, and a rod connected to the piston, the directional control valve comprising:

a control valve housing having an ambient pressure chamber communicating with an atmosphere surrounding both the pneumatic cylinder and the directional control valve;

a first pressure chamber communicating with an air supply;

a second pressure chamber communicating with one of the chambers of the cylinder housing;

a first valve means for selectively allowing communication between the first pressure chamber and the second pressure chamber; and a second valve means for selectively allowing communication between the second pressure chamber and the ambient pressure chamber; and further comprising:

a control means for controlling closing, partially opening, and fully opening one of the first valve means and the second valve means, wherein the control valve housing further defines a control means cavity; and the control means comprises;

a pressure controlling piston movably mounted in the control means cavity, where a pressure receiving chamber is formed between the control valve housing and a first side of the pressure controlling piston;

a back pressure chamber formed between the control valve housing and a second side of the pressure controlling piston;

a linkage means secured to the pressure controlling piston for opening one of the fist valve means and the second valve means corresponding to a movement of the pressure controlling piston; and the directional control valve further comprises an air supply/removal means for selectively supplying air to and removing air from the back pressure chamber and the pressure receiving chamber, the air supply/removal means supplies one of a low pressure air and a high pressure air to the back pressure chamber and comprises:

a third valve means for selectively allowing communication between pressure receiving chamber and a one of the second pressure chamber and a fourth valve means;

where the fourth valve means allows selective communication between a fifth valve means and a one of the back pressure chamber and the third valve means; and wherein the fifth valve means allows selective communication between the fourth valve means and one of a low pressure air supply and a high pressure air supply.

4. A directional control valve for a pneumatic cylinder having a cylinder housing, a piston dividing the cylinder housing into two chambers, and a rod connected to the piston, the directional control valve comprising:

a control valve housing having an ambient pressure chamber communicating with an atmosphere surrounding both the pneumatic cylinder and the directional control valve;

a first pressure chamber communicating with an air supply;

a second pressure chamber communicating with one of the chambers of the cylinder housing;

a first valve means for selectively allowing communication between the first pressure chamber and the second pressure chamber; and a second valve means for selectively allowing communication between the second pressure chamber and the ambient pressure chamber; and a control means for controlling closing, partially opening, and fully opening one of the first valve means and the second valve means, wherein the control valve housing further defines a control means cavity; and the control means comprises:

a pressure controlling piston movably mounted in the control means cavity, where a pressure receiving chamber is formed between the control valve housing and a first side of the pressure controlling piston;

a back pressure chamber formed between the control valve housing and a second side of the pressure controlling piston;

a linkage means secured to the pressure controlling piston for opening one of the first valve means and the second valve means corresponding to a movement of the pressure controlling piston; and the directional control valve further comprises an air supply/removal means for selectively supplying air to and removing air from the back pressure chamber and the pressure receiving chamber, the air supply/removal means comprising:

a third valve means for allowing selective communication between the pressure receiving chamber and a one of the second pressure chamber and a fourth valve means; and where the fourth valve means allows communication between at least one decompression valve connected to the air supply and one of the back pressure chamber and the third valve means.

5. The directional control valve of claim 4, further comprising a fifth valve means between the third and fourth valve means, the fifth valve means for selectively allowing communication between the back pressure chamber and a one of the atmosphere and the fourth valve means and further for selectively allowing the third valve means to selectively communication with the fourth valve means and the atmosphere.

* * * * *

UNITED STATES PATENT AND TRADEMARK OFFICE

CERTIFICATE OF CORRECTION

PATENT NO. : 5,085,124

DATED : February 4, 1992

INVENTOR(S) : Takashi Kimura

It is certified that error appears in the above-indentified patent and that said Letters Patent is hereby corrected as shown below: Title page:

Item [73] : change "Hirotaki Manufacturing Co., Ltd.," to --Hirotaka Manufacturing Co., Ltd.,--

Signed and Sealed this

Ninth Day of August, 1994

*Attest:*

*Attesting Officer*

BRUCE LEHMAN

*Commissioner of Patents and Trademarks*